US011891226B2

(12) United States Patent
James et al.

(10) Patent No.: US 11,891,226 B2
(45) Date of Patent: Feb. 6, 2024

(54) BASKET STYLE CARRIER, SHIPPING CARTON AND PACKAGE SYSTEM

(71) Applicant: WestRock Packaging Systems, LLC, Atlanta, GA (US)

(72) Inventors: Jeffrey S. James, Elmhurst, IL (US); Matthew E. Zacherle, Chesterfield, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 313 days.

(21) Appl. No.: 16/343,805

(22) PCT Filed: Oct. 23, 2017

(86) PCT No.: PCT/US2017/057807
§ 371 (c)(1),
(2) Date: Apr. 22, 2019

(87) PCT Pub. No.: WO2018/080962
PCT Pub. Date: May 3, 2018

(65) Prior Publication Data

US 2019/0248557 A1 Aug. 15, 2019

Related U.S. Application Data

(60) Provisional application No. 62/415,113, filed on Oct. 31, 2016.

(51) Int. Cl.
*B65D 71/58* (2006.01)
*B65D 77/04* (2006.01)

(52) U.S. Cl.
CPC ..... *B65D 71/0022* (2013.01); *B65D 77/042* (2013.01); *B65D 2571/0066* (2013.01);
(Continued)

(58) Field of Classification Search
CPC ..... B65D 71/0022; B65D 77/042; B65D 2571/00993; B65D 2571/00753;
(Continued)

(56) References Cited

U.S. PATENT DOCUMENTS 2,564,449 A 8/1951 Ringler
2,694,504 A * 11/1954 Shanahan ..... B65D 71/0022 206/173

(Continued)

FOREIGN PATENT DOCUMENTS

EP 0531278 A2 3/1993
EP 0579895 A1 1/1994

*Primary Examiner* — Ernesto A Grano
(74) *Attorney, Agent, or Firm* — Brian J. Goldberg; Rohini K. Garg

(57) ABSTRACT

The invention provide a package system comprising: at least one secondary packaging container (95) holding at least one primary container ('B'); and a tertiary packaging carton (57; 157) holding the at least one secondary packaging container (95). The at least one secondary packaging container (95) is of the basket carrier style having an open-topped structure and comprises a base wall (78/80); opposed first and second side walls (14, 18); opposed first and second end walls (12, 16); and a medial handle structure (20/22) connected to the first and second end walls (12, 16) and disposed between the first and second side walls (14, 18). Additionally, at least one corner structure (14*a*) is disposed between the first side wall (14) and the first end wall (12) of the secondary packaging container (95). At least one corner structure (43*a*) is also disposed between the first side wall and the first end wall of the tertiary packaging carton.

18 Claims, 11 Drawing Sheets

(52) U.S. Cl.
CPC ..... *B65D 2571/00141* (2013.01); *B65D 2571/00388* (2013.01); *B65D 2571/00487* (2013.01); *B65D 2571/00524* (2013.01); *B65D 2571/00753* (2013.01); *B65D 2571/00858* (2013.01); *B65D 2571/00993* (2013.01)

(58) Field of Classification Search
CPC .. B65D 2571/00141; B65D 2571/0066; B65D 2571/00858; B65D 2571/00487; B65D 2571/00388; B65D 2571/00524
USPC ..... 206/198
See application file for complete search history.

(56) References Cited

U.S. PATENT DOCUMENTS 2,974,827 A * 3/1961 Levkoff ..... B65D 71/0022 206/186
2,977,021 A * 3/1961 Shiels, Jr. ..... B65D 71/0022 206/188
3,757,991 A * 9/1973 Stout ..... B65D 71/0022 206/173
3,979,046 A * 9/1976 Wilbur ..... B65D 5/5405 229/181
4,032,007 A 6/1977 Graser
4,944,405 A * 7/1990 Buford ..... B65D 5/48008 229/120.04
5,423,420 A 6/1995 Bakx
6,598,739 B1 * 7/2003 Collura ..... B65D 71/0022 206/185
7,427,010 B2 9/2008 Sutherland
7,731,080 B2 6/2010 Zacher et al.
8,931,686 B2 1/2015 Brundage et al.
10,577,145 B2 * 3/2020 Bevier ..... B65D 5/241
2002/0158114 A1 * 10/2002 Evans ..... B65D 5/3621 229/109
2004/0211825 A1 * 10/2004 Champion ..... B65D 5/3621 229/178
2005/0011938 A1 * 1/2005 West ..... B65D 5/103 229/109
2008/0116249 A1 * 5/2008 West ..... B65D 5/029 229/109
2009/0098991 A1 * 4/2009 Graham ..... B31B 50/00 493/162
2010/0065620 A1 3/2010 Smith
2015/0321816 A1 11/2015 Holley, Jr.
2020/0198865 A1 * 6/2020 Blehm ..... B65D 71/0022

* cited by examiner

BASKET STYLE CARRIER, SHIPPING CARTON AND PACKAGE SYSTEM

FIELD OF THE INVENTION

The present invention relates to secondary package containers such as basket style carriers comprising a medial handle and optionally partitioned cells each for holding an individual item. More specifically, but not exclusively, the invention relates to a package system comprising a basket style carrier and a tertiary shipping carton having a similar shape, such that the basket style carrier can be fitted and nested into the tertiary shipping carton.

BACKGROUND OF THE INVENTION

In the field of packaging it is often required to provide consumers with a package comprising multiple primary product containers. Such multi-packs are desirable for shipping and distribution purposes and for the display of promotional information. Basket style carriers are known in which a top loaded structure comprises a medial handle panel and optionally a medial partition. Further lateral partitions are often used to divide the carrier into cells, each for holding an individual item. Such basket style carriers are particularly popular for the packaging and display of premium products contained in bottles, where the tops of the bottles are well presented within the basket style carrier for marketing purposes and where the partitioned cells help to protect the bottles and prevent, or at least mitigate against, adjacent bottles knocking against one another.

Typically, such basket style carriers are collapsible into a flat form and are easily erected into a top-loaded structure. For example, in U.S. Pat. No. 5,645,162 to Harrelson, a basket style carrier having an automatic bottom (also referred to as "crash bottom") and having lateral partition straps (36, 37, 38, 39) is shown. The basket carrier shown can hold six articles in two rows of three articles each, with the two rows being separated by a central partition and handle structure which provides an easy means by which the basket style carrier can be held and carried. The blank can be assembled into a pre-glued and folded, flat-form, collapsed structure, from which the basket carrier of U.S. '162 can be readily erected.

Typically, such basket style carriers are not stackable. The present invention offers an improvement in the field of packaging by providing a tertiary shipping carton. For transportation of such basket style carriers, once loaded with articles, it is advantageous if the basket style carriers are loaded into the tertiary package. The strength of the tertiary package and its suitability for holding and transporting large weights of articles is an important consideration.

For cost and environmental considerations, it is preferable if such tertiary shipping cartons and secondary package basket style carriers are formed from as little material as possible and cause as little wastage in the materials from which they are formed as possible. Furthermore, since the basket style carriers are often used to promote the sale of premium products the appearance of the tertiary shipping cartons is also an important consideration.

It is also desirable if the basket style carrier and shipping carton can each be assembled on existing automatic machines such that no alteration, or no significant alteration, of existing automatic machines is required.

The present invention seeks to provide an improvement in the field of packaging by providing a tertiary shipping carton having at least one corner structure and/or at least one mitred corner. Beneficially, the strength and stackability of the shipping carton is thereby improved. Additionally, there is provided a secondary package basket carrier having at least one corner structure and/or mitred corner of a similar shape to the mitred corner structure of the tertiary shipping carton so that the basket carrier can fit within and nest within the shipping carton. The overall appearance of the package system may have an improved aesthetic quality which may be an important attribute in encouraging consumers to purchase the products held therein.

SUMMARY OF INVENTION

According to a first aspect of the present invention there is provided a package system comprising at least one secondary packaging container holding at least one primary container; and a tertiary packaging carton holding the at least one secondary packaging container. The at least one secondary packaging container is of the basket carrier style having an open-topped structure and comprising a base wall, opposed first and second side walls, opposed first and second end walls, a medial handle structure connected to the first and second end walls and disposed between the first and second side walls, and at least one corner structure disposed between the first side wall and the first end wall. The tertiary packaging carton comprises a base wall, opposed first and second side walls, opposed first and second end walls, a top closure, and at least one corner structure disposed between the first side wall and the first end wall. The at least one corner structure of the secondary packaging container is sized, configured and arranged to fit internally of one of the at least one corner structures of the tertiary packaging carton.

Optionally, the at least one corner structure of the at least one secondary packaging container comprises a first corner structure having a first corner panel disposed between the first side wall and the first end wall. The first corner panel is hinged to both the first side wall and the first end wall.

Optionally, the first corner panel is sized to provide an acutely angled first corner structure.

Optionally, the at least one corner structure of the at least one secondary packaging container further comprises a second corner structure having a second corner panel disposed between the first side wall and the second end wall. The second corner panel is hinged to both the first side wall and the second end wall. A third corner structure has a third corner panel disposed between the second side wall and the second end wall, which second corner panel is hinged to both the second side wall and the second end wall.

Optionally, the secondary packaging container comprises a first securing panel hinged to the medial handle structure and affixed to the first end wall. The at least one corner structure of the at least one secondary packaging container further comprises a fourth corner structure having a fourth corner panel disposed between the second side wall and the first securing panel. The fourth corner panel is hinged to both the second side wall and the first securing panel.

Optionally, the package system comprises four secondary packaging containers. The at least one corner structure of the tertiary packaging carton comprises four corner structures. Each corner structure of the tertiary packaging carton fits adjacent to a similarly formed and shaped corner structure of one of the four secondary packaging containers.

Optionally, the tertiary packaging carton is end loaded, or the tertiary packaging container is top-loaded, and the tertiary packaging container is a fully enclosed container and stackable container.

Optionally, the at least one corner structure of the tertiary packaging carton comprises a first corner panel disposed between the first side wall and first end wall. The corner panel is hinged to both the first side wall and the second side wall.

Optionally, there is provided a secondary packaging container for use in a package system.

Optionally, there is provided a tertiary packaging container for use in a package system.

Optionally, there is provided a set of blanks for forming a secondary packaging container and a tertiary packaging container for use in a package system.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EMBODIMENTS

Figure 1:
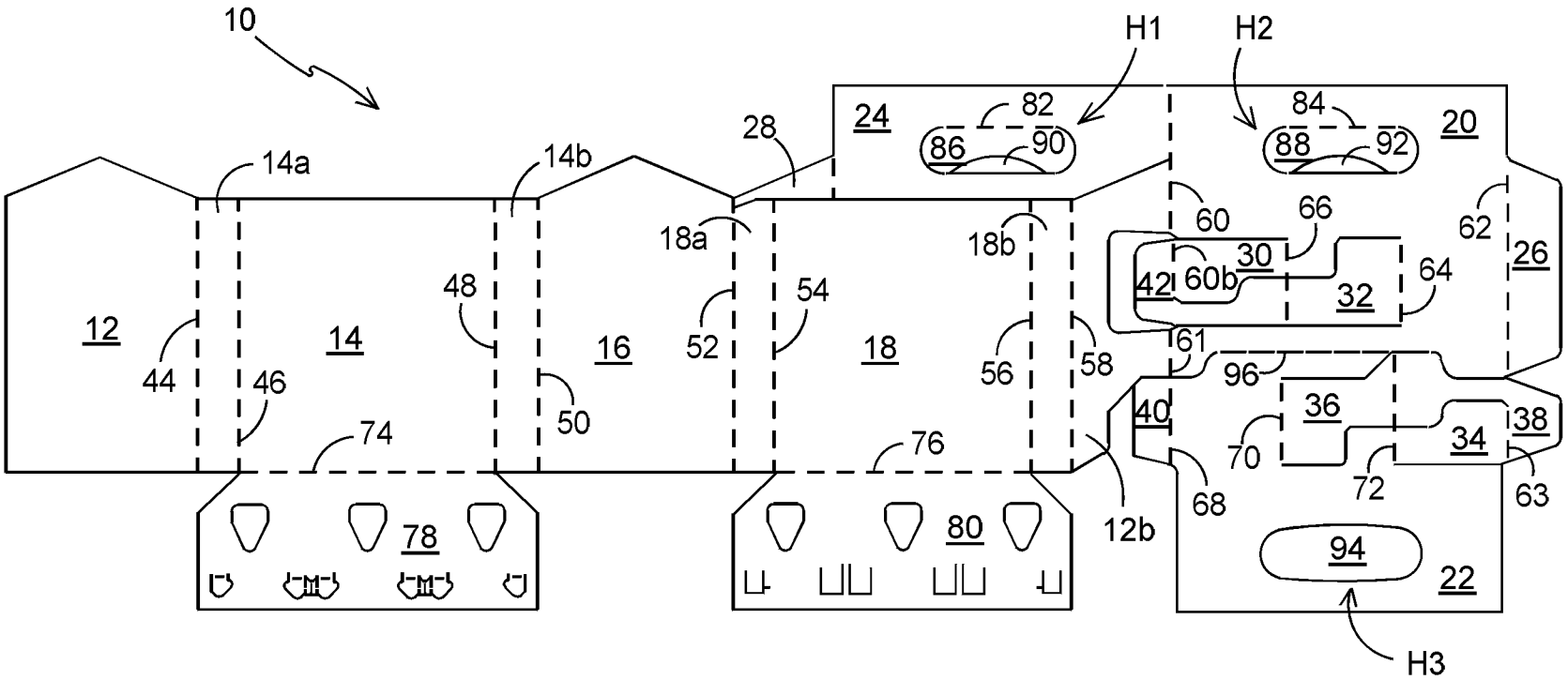
FIG. 1 is a plan view from above of a blank for forming a basket style carrier according to a first embodiment of the invention.

Detailed descriptions of specific embodiments of the package system, shipping cartons, basket carriers and blanks are disclosed herein. It will be understood that the disclosed embodiments are merely examples of the way in which certain aspects of the invention can be implemented and do not represent an exhaustive list of all of the ways in which the invention may be embodied. As used herein, the word "exemplary" is used expansively to refer to embodiments that serve as illustrations, specimens, models, or patterns. Indeed, it will be understood that the package system, shipping cartons, basket carriers and blanks described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

In the embodiments detailed herein, the terms "secondary package", "tertiary package", "carton" and "carrier" refer, for the non-limiting purpose of illustrating the various features of the invention, to a container for engaging, carrying, and/or dispensing articles, such as secondary packages or primary product containers. It is contemplated that the teachings of the invention can be applied to various primary product containers, which may or may not be tapered and/or cylindrical. Optional containers include bottles (for example metallic, glass or plastics bottles), cans (for example aluminum cans), tins, pouches, packets and the like. It should also be contemplated that the teachings of the invention may also be applied to various secondary package containers, which may or may not have top/cover panels. Optional containers include top/bottom-loading basket style carriers, end-loading tubular cartons having full or partial end closure panels, wraparound style carriers having full or partial end closure panels, top-gripping carriers and top/bottom-loading tubular cartons.

A package system 97 is disclosed herein (see FIG. 9) that comprises a tertiary shipping carton 57; 157 (see FIGS. 8 and 11), a secondary package basket style carrier 95 (see FIG. 6); and a plurality of articles 'B', arranged in groups and held within each basket carrier 95. The tertiary shipping cartons 57; 157 are formed from blanks 13; 113 (see FIGS. 7 and 10) formed from a sheet of suitable substrate; and the basket carrier 95 is formed from a blank 10 (see FIG. 1) formed from a sheet of suitable substrate. The blanks 10, 13; 113 may be formed from the same or from different substrates.

It is to be understood that, as used herein, the term "suitable substrate" includes all manner of foldable sheet material such as paperboard, corrugated board, cardboard, plastic, combinations thereof, and the like that may be coated, uncoated, printed or not printed. It should be recognized that one or other numbers of blanks may be employed, where suitable, for example, to provide the structures described in more detail below. Optionally, the blank 10 for forming the basket carrier 95 may be formed from a paperboard that is bleached, coated and printed on one surface thereof and which is not bleached, coated or printed on the other (inside) surface thereof ("the brown-side"). Optionally, the blanks 13; 113 for forming the shipping cartons 57; 157 are formed from a corrugated board which provides structural rigidity and stacking strength such that the shipping cartons 57; 157 can accommodate a heavy load of articles.

In an illustrated and optional embodiment, the blank 10 is configured to form a basket style carrier 95 for packaging an optional arrangement of articles. In this illustrated embodiment, the arrangement is a 2×3 matrix and the articles are 12 oz. bottles 'B'. Optionally each bottle 'B' is held within an individual cell defined by medial and lateral partition structures. However, this is entirely optional and in other arrangements, the articles may not be bottles and/or the bottles may not be held in individual cells as such. The blank 10 can be alternatively configured to form a carrier for packaging other types, number and size of article and/or for packaging articles in a different arrangement or configuration.

In the illustrated and optional embodiment, the blank 13; 113 is configured to form a shipping carton 57; 157 that can optionally accommodate four basket style carriers 95; and as such the shipping carton 57; 157 may comprise 24, 12 oz. bottles 'B'. Accordingly, the package system 97 accommodates a significant load.

Referring now to FIG. 1, the blank 10 comprises a series of main panels for forming the main walls of the basket carrier 95. The series of main panels comprises: a first end panel 12, a first corner panel 14*a*, a first side panel 14, a second corner panel 14*b*, a second end panel 16, a third corner panel 18*a*, a second side panel 18, a fourth corner panel 18*b*, a first securing panel 12*b*, a first medial handle panel 20, a second medial handle panel 22, a handle reinforcing panel 24, a second securing panel 26, a first bottom panel 78 and a second bottom panel 80. Optionally the series of main panels 12, 14*a*, 14, 14*b*, 16, 18*a*, 18, 18*b*, 12*b*, 20, 22, 24, 26, 78, 80 are hinged together along fold lines 44, 46, 48, 50, 52, 54, 56, 58, 60, 61, 62, 63, 96, 68*a* 74, 76.

More specifically, a first edge of first end panel 12 is hinged by a fold line 44 to a first edge of first corner panel 14*a*. A second edge of first corner panel 14*a* is hinged by a fold line 46 to a first edge of first side panel 14. A second edge of first side panel 14 is hinged by fold line 48 to a first edge of the second corner panel 14*b*. A second edge of second corner panel 14*b* is hinged by a fold line 50 to a first edge of second end panel 16. A second edge of second end panel 16 is hinged by a fold line 52 to a first edge of third corner panel 18*a*. A second edge of third corner panel 18*a* is hinged by a fold line 54 to a first edge of second side panel 18. A second edge of second side panel 18 is hinged by fold line 56 to a first edge of fourth corner panel 18*b*. A second edge of fourth corner panel 18*b* is hinged by fold line 58 to a first edge of a first securing panel 12*b*. A second edge of the first securing panel 12*b* is hinged by spaced fold lines 60, 61 to a first edge of the first medial handle panel 20. A second edge of first medial handle panel 20 is hinged by fold line 62 to a second securing panel 26; and a lower edge of the first medial handle panel 20 is hinged by fold line 96 to the second medial handle panel 22. The handle reinforcing panel 24 is hinged to the first edge of first medial handle panel 20 by means of a section of fold line 60. Handle reinforcing panel 24 is separated from the upper edges of the first securing panel 12*b*, fourth corner panel 18*b*, second side panel 18 and third corner panel 18*a* by a cut line. The handle reinforcing panel 24 is also hinged to a connecting panel 28 which is attached by a small connecting portion to an upper portion of the second edge of the second end panel 16.

The first bottom panel 78 is hinged to a bottom edge of first side panel 14 by fold line 74. The second bottom panel 80 is hinged to a bottom edge of the second side panel 18 by fold line 76. The first and second bottom panels 78, 80 are each free of connection to the first, second, third and fourth corner panels 14*a*, 14*b*, 18*a*, 18*b*. Optionally, in the illustrated arrangement, components for forming a punch-locking system (complementary male and female locking tabs, see FIG. 1) are provided in bottom panels 78 and 80. Such a mechanism for forming the bottom wall structure 78/80 is not essential and in other arrangements, other mechanical locking mechanisms may be used and/or adhesive may be used to affix first and second bottom panels 78, 80 together.

The handle reinforcing panel 24, and first and second medial handle panels 20, 22 each comprises components H1, H2, H3 that together form a handle structure. The configuration, shape, size, position and overall arrangement of the handle structure is entirely optional. In the illustrated optional arrangement, the first medial handle panel 20 comprises a segment-shaped aperture 92, and a cushioning flap 88 hinged by a fold line 84 to the first medial handle panel 20 and separated from the first medial handle panel 20 by arcuate cut lines. The second medial handle panel 22 comprises an aperture 94, shaped and positioned in a similar manner to the outline shape of the cushioning flap 88 and segment-shaped aperture 92, such that once the first and second medial handle panels 20, 22 are overlaid, the aperture 94 is aligned with the outer edges of the handle component H2. The handle reinforcing panel 24 comprises a segment-shaped aperture 90, and a cushioning flap 86 hinged by a fold line 82 to the handle reinforcing panel 24. Once the second medial handle panel 22 is sandwiched between the first medial handle panel 20 and the handle reinforcing panel 24, the aperture 94 is aligned with the outer edges of the handle components H1, H3.

In the illustrated arrangement of the blank 10 forming the basket carrier 95, the first and second medial handle panels 20, 22 are hinged together about a bottom fold line 96, and each has a height sufficient such that each medial handle panel 20, 22 can divide or partition the basket carrier 95 once formed from the blank 10 into two major sections. Additionally, each of the first and second medial handle panels 20, 22 comprises an optional lateral partition structure arrangement. In other embodiments, there may be no lateral partition structure arrangement. In FIG. 1, however, it can be seen that a first lateral partition flap 30 is hinged to the first medial handle panel 20 by part of a fold line 66; and is hinged to a third securing panel 42 by a further fold line 60*b*. A second lateral partition flap 32 is hinged to the first medial handle panel 20 by a fold line 64 and is hinged to the third securing panel 42 by a lower part of fold line 66. A third lateral partition flap 36 is hinged to the second medial handle panel 22 by a fold line 70 and is hinged to fourth securing panel 38 by a section of fold line 72. A fourth lateral partition flap 34 is hinged by a further section of fold line 72 to the second medial handle panel 22, and is hinged to the fourth securing panel 38 by a fold line 63. To assist in attaching the second medial handle panel 22 to the first end panel 12, a fifth securing panel 40 is provided, hinged along fold line 68 to the second medial handle panel 22.

Figure 4:
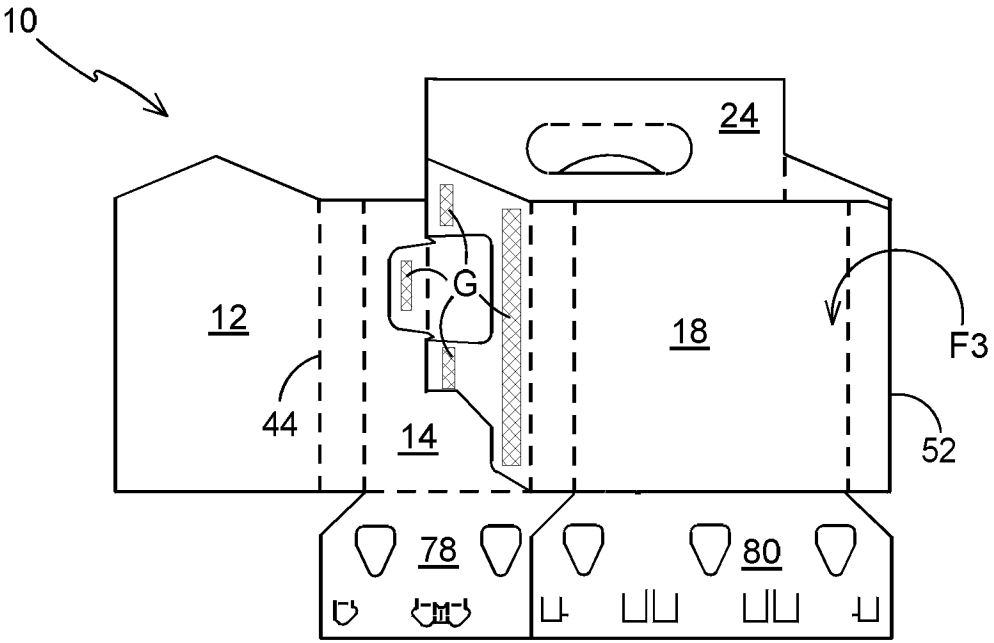
Figure 5:
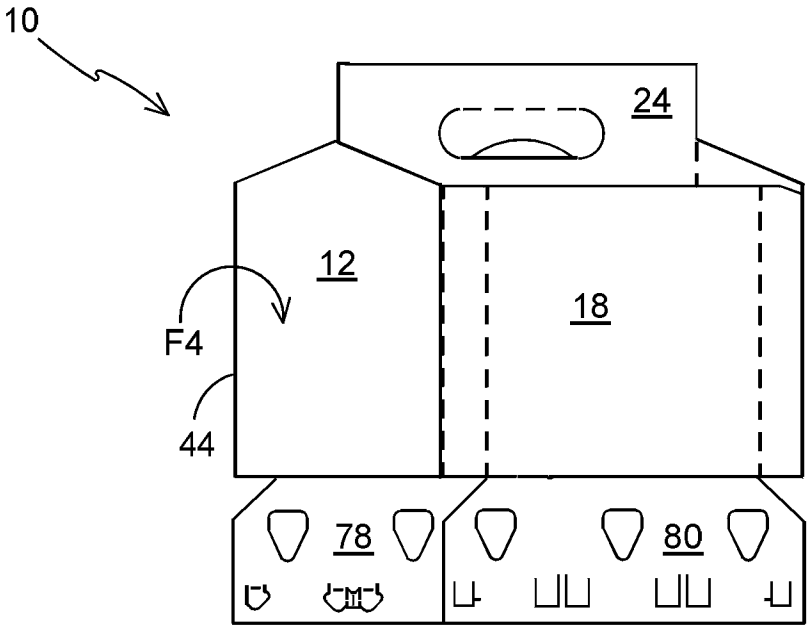
Figure 6:
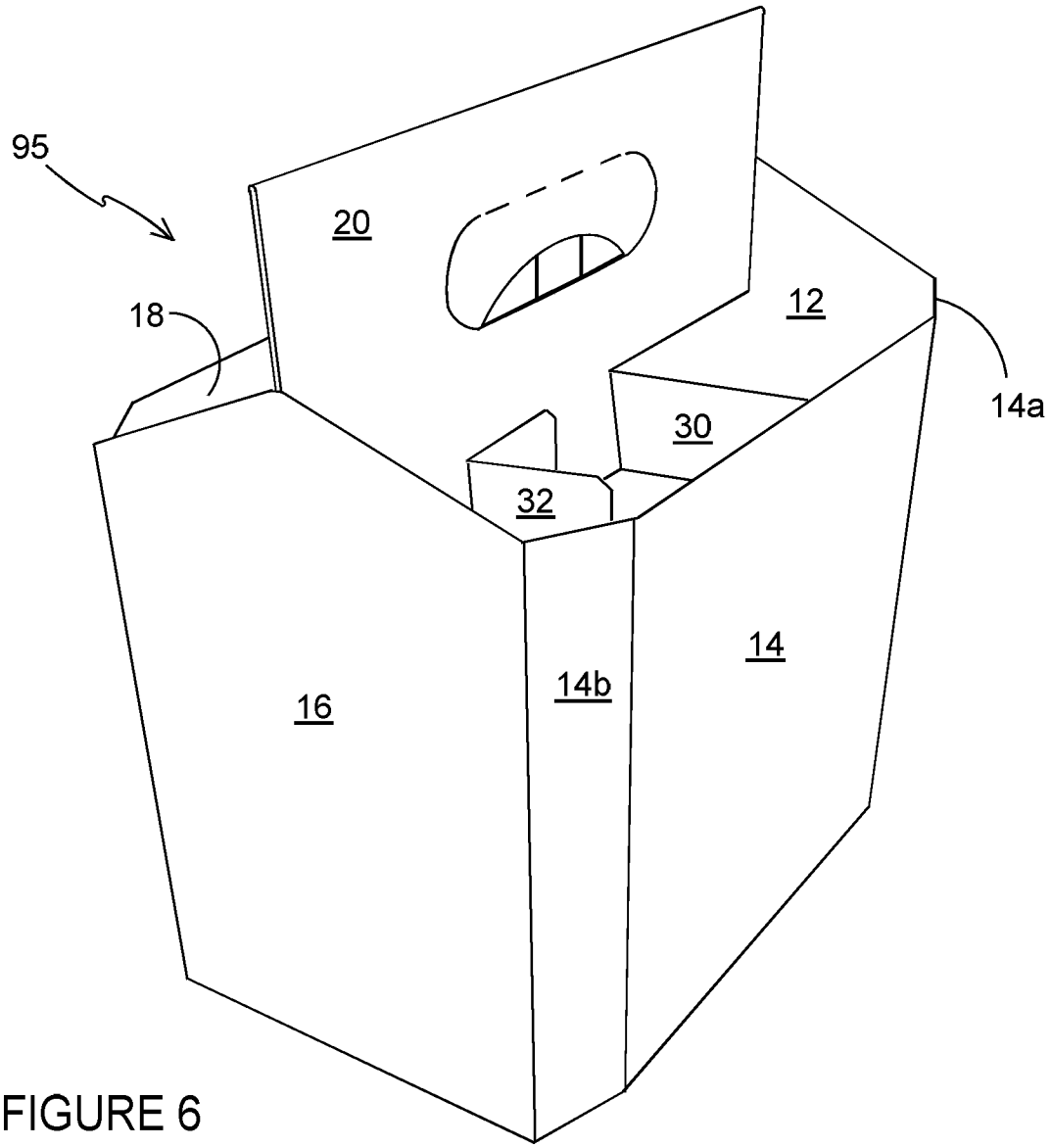
FIG. 6 is a perspective view of a basket style carrier formed from the blank of FIG. 1.

Turning to the construction of the basket carrier 95 as illustrated in FIG. 6, it is envisaged that the basket carrier 95 can be formed by a series of sequential folding operations in a straight line machine so that the basket carrier 95 is not required to be rotated or inverted to complete its construction. The folding process is not limited to that described below and as illustrated in FIGS. 2 to 5, and may be altered according to particular manufacturing requirements.

Affixing means such as adhesive, more specifically a hot melt glue, may be applied to sections of the inside (non-printed) of the second medial handle panel 22 in regions around aperture 94 and handle structure H3, and proximate to the fold line 96. The second medial handle panel 22 is then folded, as shown by arrow F1 in FIG. 2, about fold line 96. The second medial handle panel 22 is then disposed in face contacting relationship with the first medial handle panel 20 and is attached thereto in the regions around aperture 94, and proximate to fold line 96. In other arrangements affixing means could be applied to corresponding regions of the first medial handle panel 20 as well as, or instead of, applying affixing means to the second medial handle panel 22.

Figure 2:
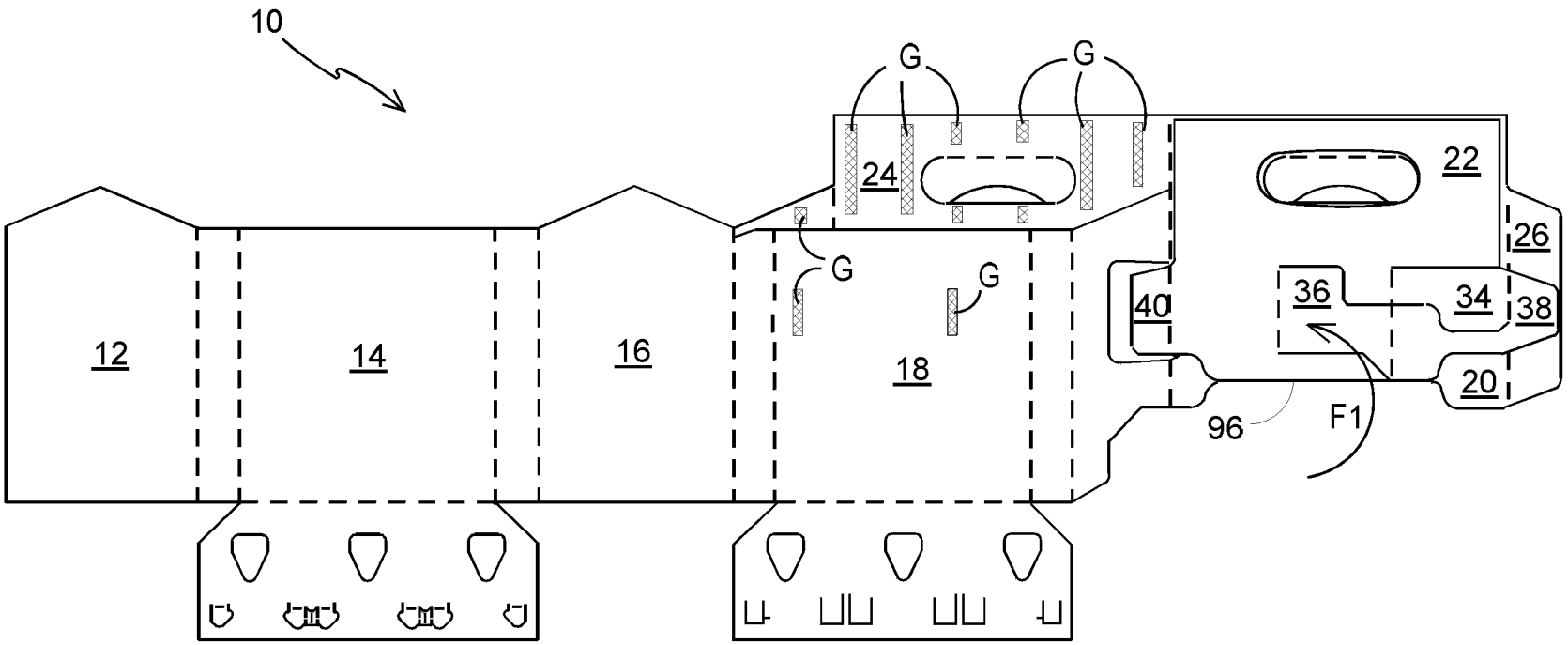
FIG. 2 is a perspective view from above of a first step in an assembly sequence for constructing the blank of FIG. 1 into a basket style carrier.
Figure 3:
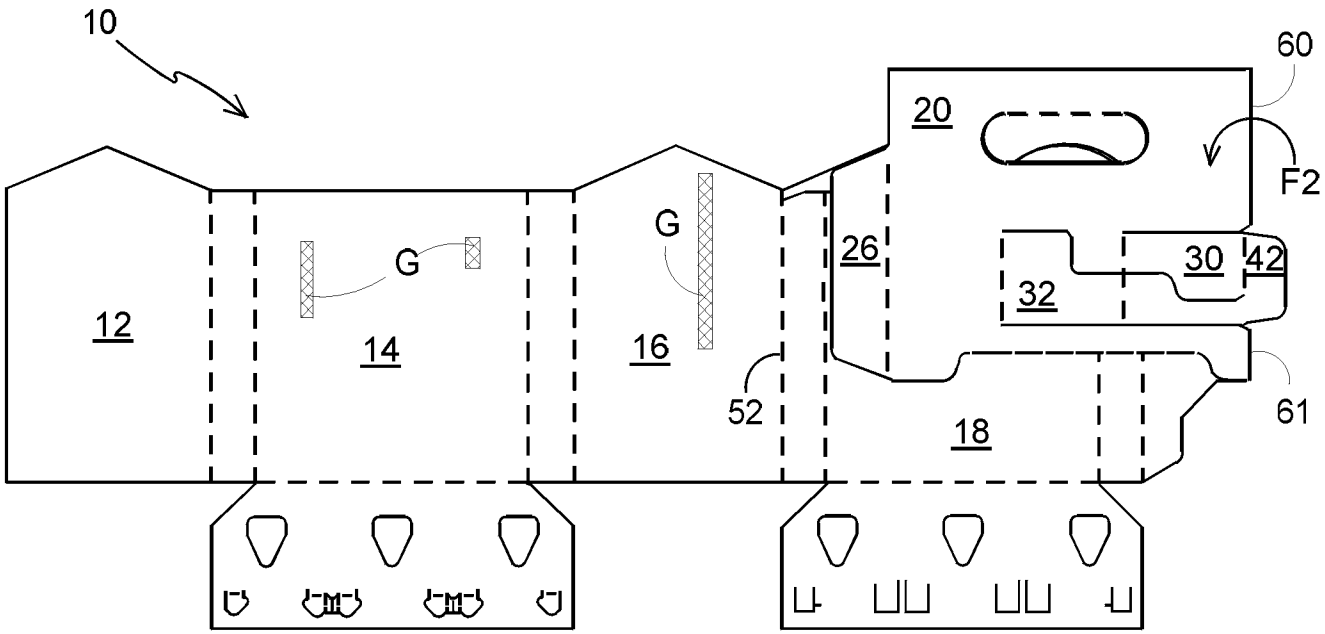
FIGS. 3 to 5 show further steps in the assembly sequence for constructing the blank of FIG. 1 into a basket style carrier.

As shown in FIG. 2, affixing means G such as adhesive, more specifically a hot melt glue, may be applied to sections of the inside (non-printed) of the connecting panel 28, handle reinforcing panel 24 (in the region of the handle component H1), and to regions of the inside surface of the second side panel 18 as shown. Then, as shown in FIG. 3, the first and second medial handle panels 20, 22 are together folded as a unit about fold lines 60 and 61, as shown by arrow F2. In this way, the handle reinforcing panel 24 is affixed to the outside surface of the second medial handle panel 22, in the region of the second handle component H3; the fourth securing panel 38 is affixed to the inside surface of the second side panel 18; and the connecting panel 28 is affixed to an upper portion of second securing panel 26. In other arrangements affixing means could be applied to corresponding regions of the first medial handle panel 20, fourth securing panel 38, and second securing panel 26 as well as, or instead of, applying affixing means to the connecting panel 28, handle reinforcing panel 24 and second side panel 18.

As also illustrated in FIG. 3, affixing means G such as adhesive, more specifically a hot melt glue, may be applied to sections of the inside (non-printed) of the first side panel 14 and second end panel 16. The blank 10, as shown in FIG. 4, is then folded as indicated by arrow F3, about fold line 52 to bring the second securing panel 26, first medial handle panel 20, and third securing panel 42 into face contacting relationship with second end panel 16, second corner panel 14*b* and first side panel 14. In this way, an outside surface of the second securing panel 26 is affixed to the inside surface of the second end panel 16; and an outside surface of the third securing panel 42 is affixed to the first side panel 14. In other arrangements affixing means could be applied to corresponding regions of the second securing panel 26 and third securing panel 42, as well as or instead of to the first side panel 14 and second end panel 16.

As also illustrated in FIG. 4, affixing means G such as adhesive, more specifically a hot melt glue, may be applied to sections of the outside (coated and/or printed) of the first securing panel 12*b* and fifth securing panel 40. As illustrated by arrow F4 in FIG. 5, the blank 10 is then folded about fold line 44, to bring the first end panel 12 into face contacting relationship with the first securing panel 12*b* and the fifth securing panel 40. In this way, the first end panel 12 is affixed to the first securing panel 12*b* and fifth securing panel 40. In other arrangements affixing means could be applied to corresponding regions of the first end panel 12 as well as, or instead of, the first securing panel 12*b* and fifth securing panel 40.

The part-formed, flat folded blank shown in FIG. 5 may be shipped in that condition to a converting plant, whereat the assembly of the basket carrier 95 is completed.

To complete the construction of a basket carrier 95 from the blank 10, the part-formed, flat folded blank shown in FIG. 5 is opened, optionally by pushing on the first and second end wall panels 12, 16 in order to push apart the first and second side panels 14, 18. In doing this the first, second, third and fourth lateral partition flaps 30, 32, 36, 34 are automatically erected and a medial handle structure 20/22/24, optionally comprising three plies (first and second medial handle panels 20, 22 and reinforcing handle panel 24), is set up and is disposed between the opposed and spaced apart first and second side panels 14, 18. The medial handle structure 20/22/24 is connected to the first and second end panels 12, 16 by means of connecting panel 28, and first, second, third, fourth and fifth securing panels 12*b*, 26, 42, 38, 40. The first and second bottom panels 78, 80 can then be folded about fold lines 74 and 76 respectively until they overlap sufficiently such that the complementary locking mechanism can be deployed to affix the first and second bottom panels 78, 80 together to form a bottom structure 78/80. Optionally, the bottom structure 78/80 is shaped to match the otherwise open bottom end of the basket carrier 95 and has at least one mitred corner in order to follow the shape created by the at least one corner panel 14*a*, 14*b*, 18*a*, 18*b* provided within the basket carrier 95. In other arrangements, the medial handle structure 20/22/24 may comprise more or fewer plies than three plies; and/or may be connected to the first and second end walls 12, 16 by more or fewer securing panels; and/or may have a different height relative to the first and second end walls 12, 16; and/or may extend to a further or lesser extent towards the bottom structure 78, 80. In various arrangements, the bottom structure 78/80 may have a shape that is not similar to the outline shape of the otherwise open bottom end of the basket carrier 95 and gaps may exist between the edges of the bottom structure and the walls of the basket carrier.

The completed basket carrier 95 is shown in FIG. 6. As can be seen the basket carrier 95 is open-topped; has a generally centrally disposed carrying handle; and has an eight sided shape comprising: the spaced and facing first and second side walls 14, 18; the spaced and facing first and second end walls 12, 16; and the four angled corner panels 14*a*, 14*b*, 18*a*, 18*b*. The four corner panels 14*a*, 14*b*, 18*a*, 18*b* are disposed at an angle and cut across a perpendicular corner that would otherwise have existed between the first end panel 12 and first side panel 14; the first side panel 14 and second end panel 16; the second end panel 16 and the second side panel 18; and the second side panel 18 and the first end panel 12 respectively. The provision of each of the four mitred corner panels 14*a*, 14*b*, 18*a*, 18*b* allows for the lengths of the first and second side panels 14, 18 to be reduced compared to what they would otherwise need to be in a basket style carrier with four perpendicular corners. Similarly, the provision of each of the four corner panels 14*a*, 14*b*, 18*a*, 18*b* allows for the widths of the first and second end panels 12, 16 to be reduced compared to what they would otherwise need to be in a basket style carrier with four perpendicular corners. Overall, the end to end length of the blank 10 is reduced compared to the end to end length of a blank configured to form a straight edged basket carrier capable of holding the same number of same sized articles. In this way the provision of at least one corner structure having a mitred corner panel provides a material saving, reduces the cost and environmental impact of the carton and, further beneficially, may allow for a greater integer number of blanks to be struck from a single standard-sized sheet of paperboard material.

Figure 8:
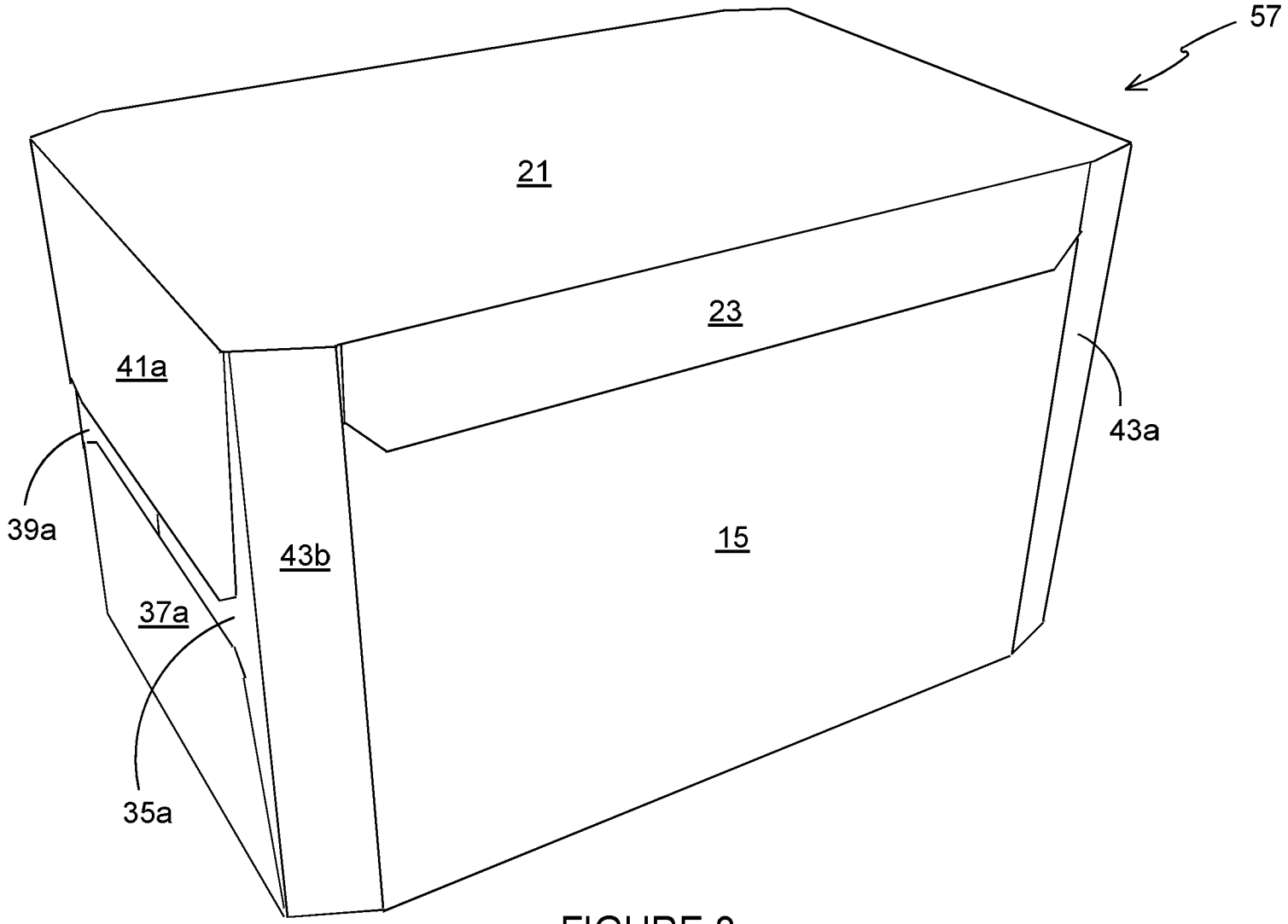
FIG. 8 is a perspective view from above of a package system comprising a tertiary shipping carton formed from the blank of FIG. 7 and a group of secondary package basket style containers formed from the blank of FIG. 1 and each loaded with articles.

Articles such as bottles 'B' may be top-loaded into the basket carrier 95 into each of the six individual cells created by the medial handle structure 20/22/24 and lateral partition structures 30, 32, 36, 34. In this way a secondary packaging container 95, in the form of a basket carrier that is open-topped and that has a medial handle structure disposed between the opposed first and second side panels and connected to the first and second end panels, is provided. The secondary packaging container 95 is suitable for holding at least one primary container, optionally a bottle 'B'. As shown in FIGS. 6 and 8, each secondary packaging container 95 formed from a blank 10 has six cells arranged in 2×3 array such that each secondary packaging container 95 is capable of holding up to six articles. In other arrangements, the blank may be configured such that secondary packaging container is capable of holding a greater or fewer number of articles B.

The completed, loaded secondary packaging basket carrier style containers 95 cannot be stacked reliably and without risking damage to the articles B contained therein. Accordingly, transportation of the basket carriers 95 can be improved by providing tertiary shipping cartons 57; 157 into which at least one of the secondary containers 95 can be loaded. Beneficially, the present disclosure provides blanks 13, 113 for forming the tertiary shipping carton 57, 157, which also comprises one or more corner structures comprising mitred corner panels. Accordingly, the tertiary shipping cartons 57; 157 may also benefit from a reduction in overall packaging material required to create a structure capable of enclosing at least one secondary container. Advantageously, the tertiary shipping cartons 57; 157 can securely and tightly (snugly) fit the at least one secondary basket-style container 95 therein such that wear or damage to the basket carrier 95 once contained in the tertiary carton 57 is minimized or completely prevented.

Figure 7:
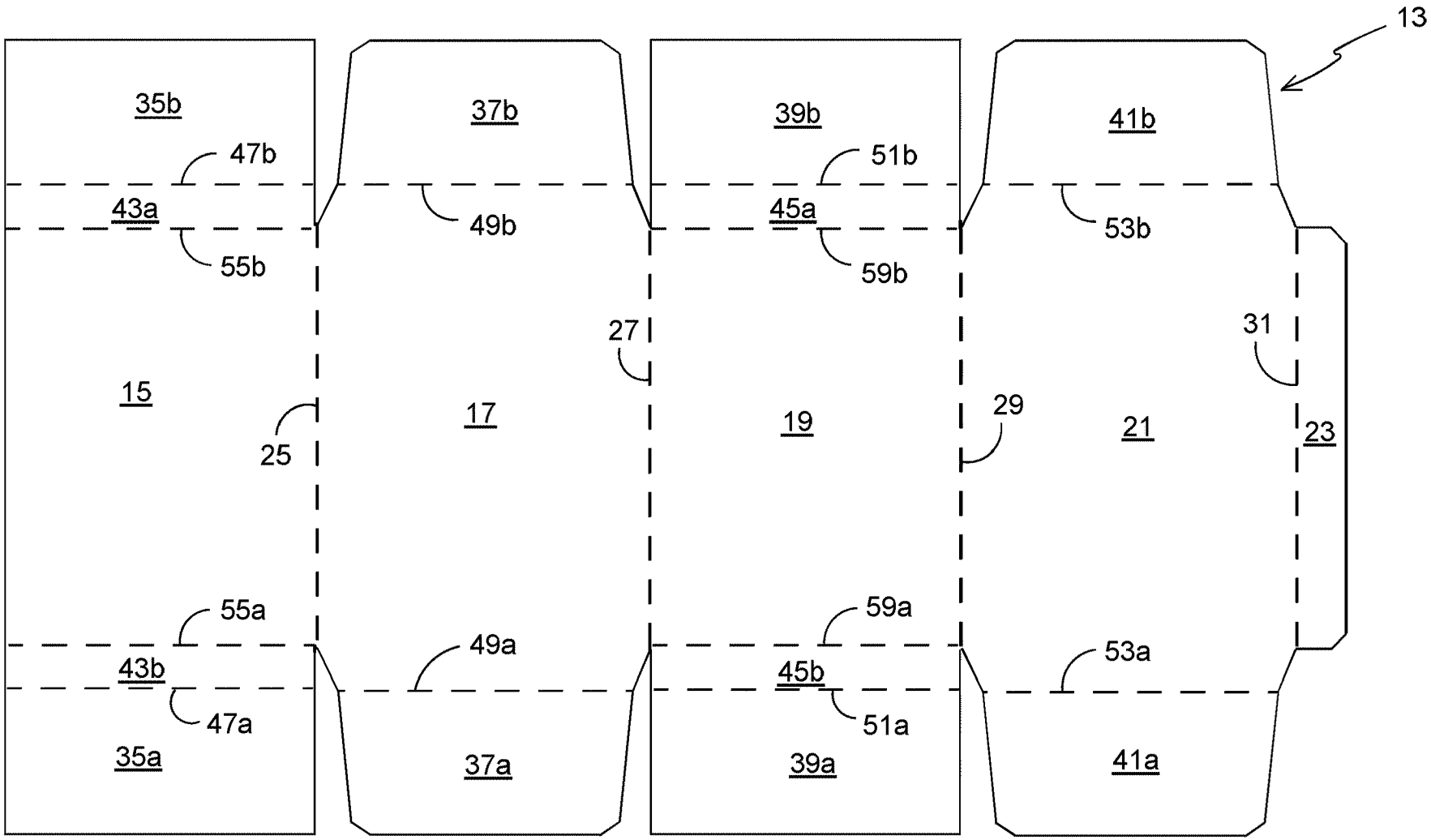
FIG. 7 is a plan view from above of a blank for forming a tertiary shipping carton according to various embodiments.

Referring now to FIG. 7, the blank 13 comprises: a first side panel 15, bottom panel 17, second side panel 19, top panel 21 and securing panel 23. The first side panel 15, bottom panel 17, second side panel 19, top panel 21 and securing panel 23 are hinged one to the next in series along fold lines 25, 27, 29 and 31 respectively. Additionally, the blank 13 comprises first and second corner panels 43*a*, 43*b*; and third and fourth corner panels 45*a*, 45*b*. The first and second corner panels 43*a*, 43*b* are hinged to first and second ends of the first side panel 15 by fold lines 55*b* and 55*a* respectively. The third and fourth corner panels 45*a*, 45*b* are hinged to the first and second ends of the second side panel 19 by fold lines 59*b* and 59*a* respectively.

The main panels 15, 17, 19, 21 are folded to form a tubular structure. To close the open ends of the tubular structure, end closure flaps 35*b*, 37*b*, 39*b*, 41*b*, 35*a*, 37*a*, 39*a*, 41*a* are provided. A first end closure flap 35*b* is hinged by fold line 47*b* to the first corner panel 43*a*. A second end closure flap 37*b* is hinged by fold line 49*b* to a first end of the bottom panel 17. A third end closure flap 39*b* is hinged by fold line 51*b* to third corner panel 45*a*. A fourth end closure flap 41*b* is hinged by fold line 53*b* to a first end of top panel 21.

A fifth end closure flap 35*a* is hinged by fold line 47*a* to the second corner panel 43*b*. A sixth end closure flap 37*a* is hinged by fold line 49*a* to a second end of the bottom panel 17. A seventh end closure flap 39*a* is hinged by fold line 51*a* to fourth corner panel 45*b*. An eighth end closure flap 41*a* is hinged by fold line 53*a* to a second end of top panel 21.

To form a flat, collapsed, part-formed shipping container, the blank 13 is folded about fold line 25 to bring the first side panel 15 into overlapping relationship with part of the bottom panel 17. Affixing means may applied to the inner surface of the glue panel 23. Then the blank 13 may be folded about fold line 29 to bring the top panel 21 into face contacting relationship with the second side panel 19 and to bring the glue panel 23 into face contacting relationship with the first side panel 15. In this way the securing panel 23 is attached to the outside surface of the first side panel 15.

The flat form part assembled blank 13 can then be opened out into an open-ended tubular structure which can be loaded through one or both of the open ends with at least one, and in this arrangement with four, secondary packaging basket style containers 95. The first end of the shipping carton 57 is then closed by folding the first and third corner panels 43*a*, 45*a* about fold lines 55*b*, 59*b*. Then, the first and third end closure flaps 35*b*, 39*b* are folded about fold lines 47*b*, 51*b*, followed by the second end closure panel 37*b* being folded about fold line 49*b* and then the top end closure panel 41*b* being folded about fold line 53*b*. Affixing means such as adhesive may be applied to appropriate regions of one or more or all of the first, second, third, and fourth end closure flaps 35*b*, 37*b*, 39*b*, 41*b*, such that as they are folded into overlapping relationship they are secured together to form a composite end wall 35*b*/37*b*/39*b*/41*b*. The second end of the shipping carton 57 is closed in a similar manner. The two open ends may be closed at the same time. The completed tertiary shipping carton 57, comprising four secondary basket style containers 95 and twenty-four bottles, is shown in FIG. 8. The folding and assembly arrangement described is optional and the tertiary shipping carton 57 may be assembled in a different manner.

Figure 9:
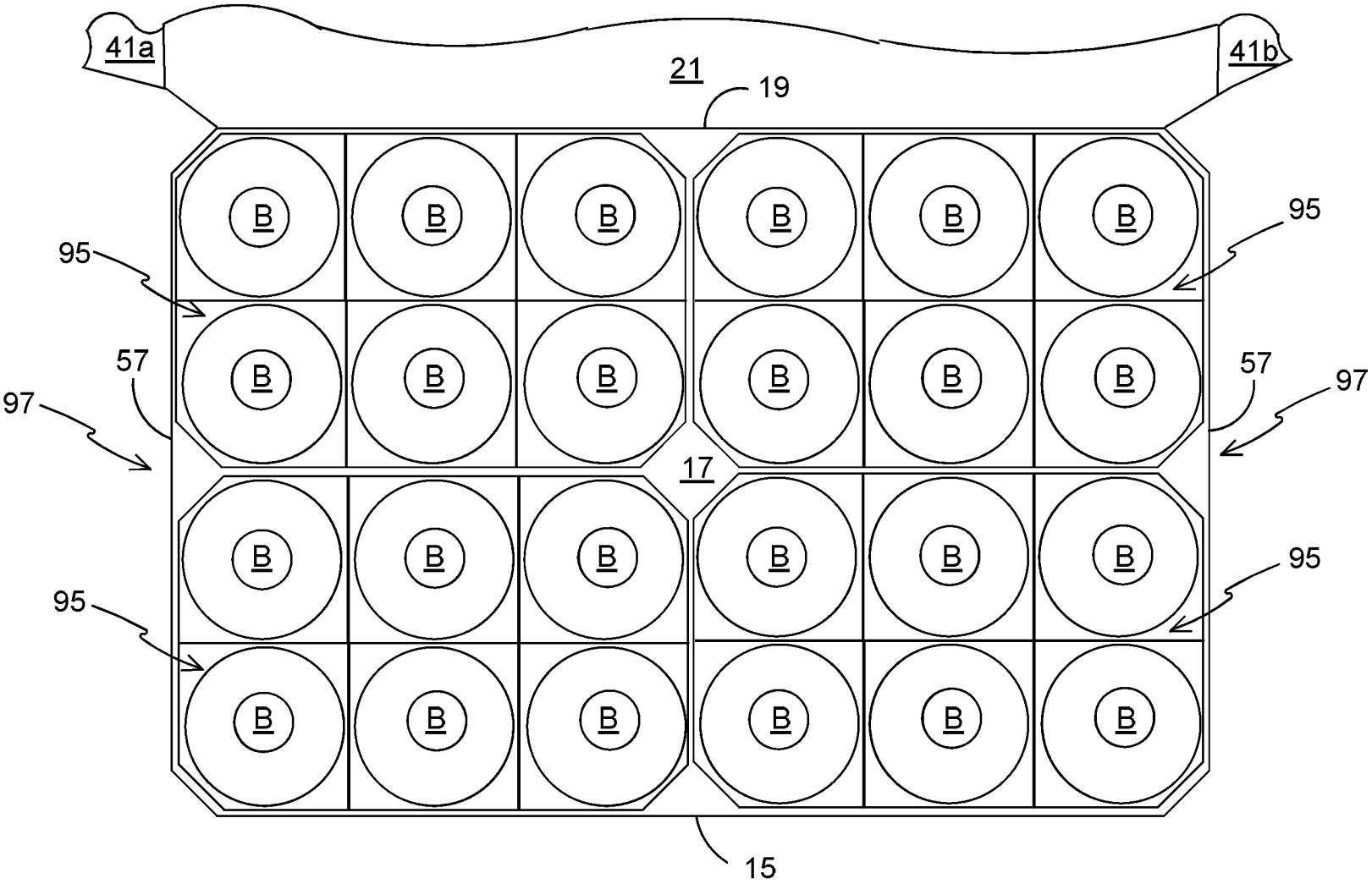
FIG. 9 is a perspective view from above of a package system comprising the shipping carton of FIG. 8, loaded with the basket style carriers of FIG. 6 (each loaded with bottles)

To illustrate the close fitting nature of the secondary packaging containers 95 within the tertiary carton 57, in FIG. 9 there is shown a plan view from above of a packaging system 97 comprising a tertiary shipping carton 57 wherein the top wall 21 and top end closure flaps 41*a*, 41*b* have been removed in order to illustrate the four secondary packaging containers 95 disposed therein, each having four corner panels 14*a*, 14*b*, 16*a*, 16*b* and each holding articles 'B'. As can be seen, four corner panels 14*a*, 14*b*, 16*a*, 16*b* of the four secondary packaging containers 95 are sized, configured and arranged to fit internally of and against a corresponding one of the four corner structures 43*a*, 43*b*, 45*a*, 45*b* of the tertiary shipping carton 57. The nested basket carriers 95 fit snugly within the shipping carton 57 and the package system 97 thereby produced is readily and reliably stackable.

Figure 10:
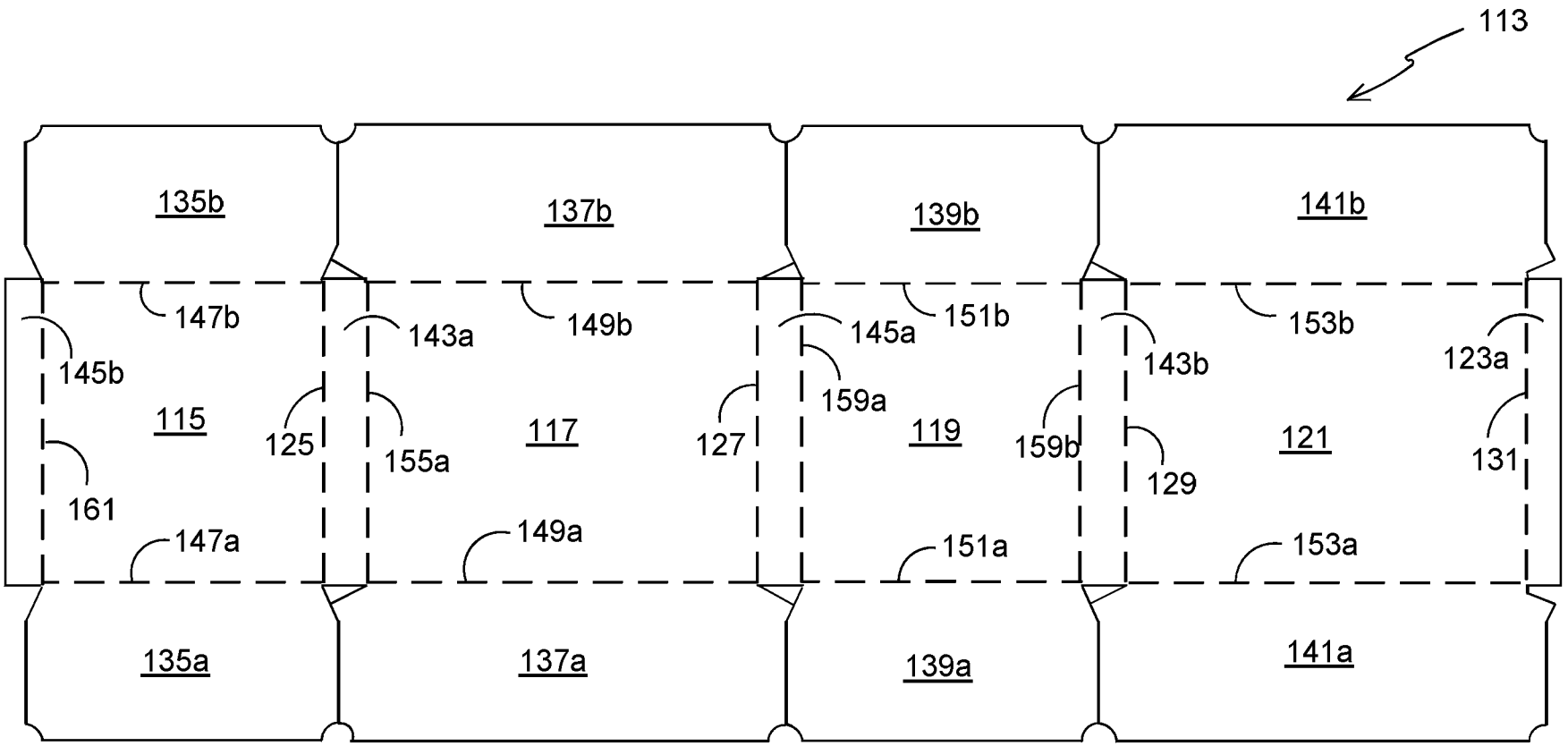
FIG. 10 is a plan view from above of a blank for forming a shipping carton according to various embodiments.
Figure 11:
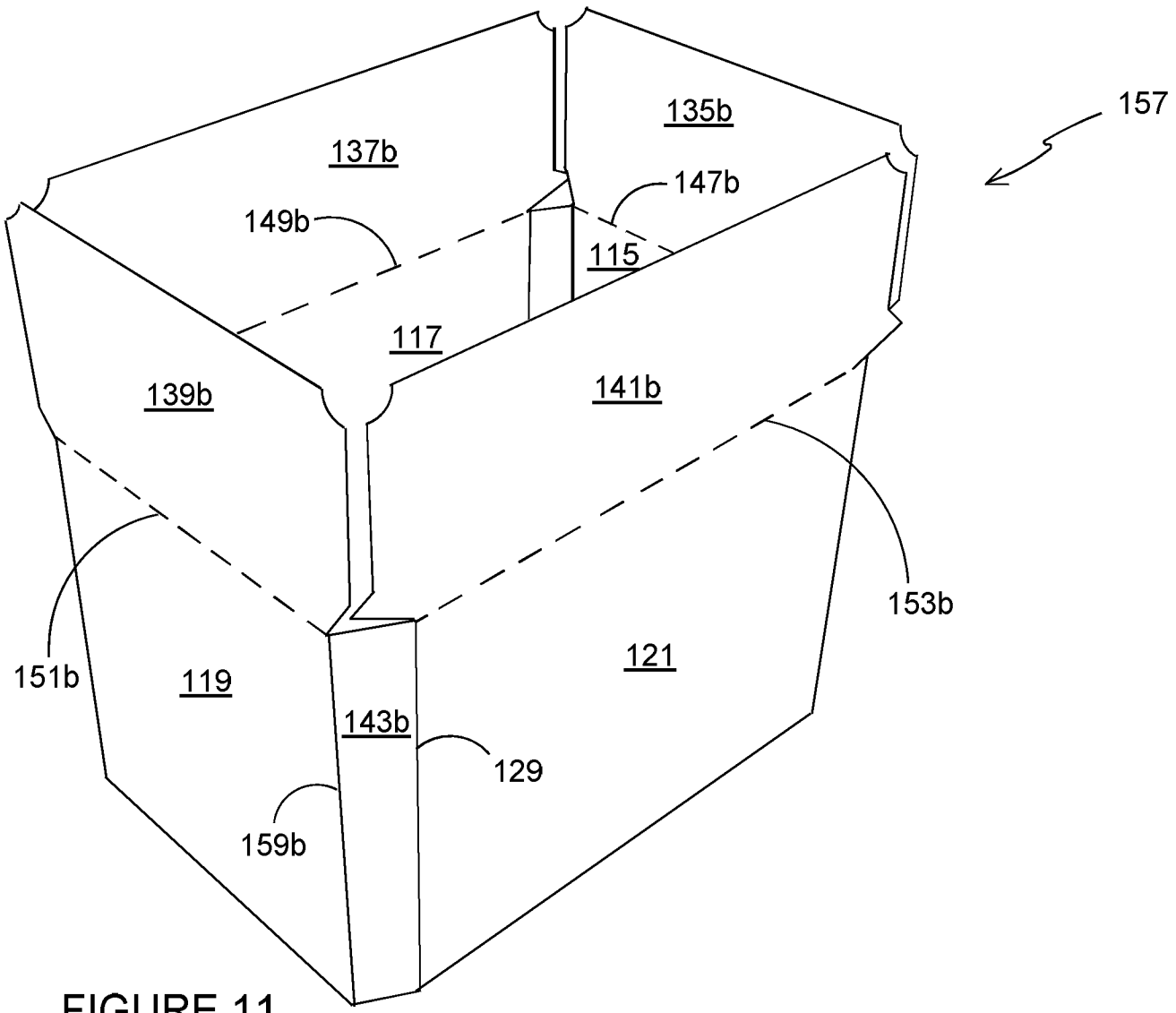
FIG. 11 is a perspective view from above of a shipping carton formed from the blank of FIG. 10.

Referring now to FIGS. 10 and 11 there is a further embodiment of a tertiary shipping carton 157, which may be used in conjunction with one or more secondary packaging containers 95 such as the basket style secondary container 95 shown in FIG. 6. In FIGS. 10 and 11 like numerals have, where possible, been used to denote like parts, albeit with the addition of the prefix "100" to differentiate these features from the tertiary shipping carton 57 shown in FIGS. 7, 8 and 9. The adaptation of tertiary shipping container 157 as illustrated in FIGS. 10 and 11 shares many common features with the shipping container of FIGS. 7, 8 and 9 and therefore only the differences will be described in any greater detail.

Blank 113 comprises a first corner panel 145*b*, a first end panel 115, a second corner panel 143*a*, a first side panel 117, a third corner panel 145*a*, a second end panel 119, a fourth corner panel 143*b*, a second side panel 121 and a first securing panel 123*a*. The first corner panel 145*b* is hinged along fold line 161 to a first edge of the first end panel 115. The first end panel 115 is hinged by fold line 125 to the second corner panel 143*a*, which in turn is hinged by fold line 155*a* to first side panel 117. First side panel 117 is hinged by fold line 127 to third corner panel 145*a*, which in turn is hinged along fold line 159*a* to second end panel 119. Second end panel 119 is hinged by fold line 159*b* to fourth corner panel 143*b*, which in turn is hinged by fold line 129 to second side panel 121. Second side panel 121 is hinged by fold line 131 to first securing panel 123*a*.

To close the top and bottom of the tertiary shipping container 157, a series of end closure flaps 135*b*, 137*b*, 139*b*, 141*b*, 135*a*, 137*a*, 139*a*, 141*a* is provided. A first end closure flap 135*b* is hinged by fold line 147*b* to the first end panel 115. A second end closure flap 137*b* is hinged by fold line 149*b* to the first side panel 117. A third end closure flap 139*b* is hinged by fold line 151*b* to the second end panel 119. A fourth end closure flap 141*b* is hinged by fold line 153*b* to the second side panel 121. Each of the first, second, third and fourth end closure flaps 135*b*, 137*b*, 139*b*, 141*b* is not connected to a corner panel 145*b*, 143*a*, 145*a*, 143*b*.

Together the first, second, third and fourth end closure flaps 135*b*, 137*b*, 139*b*, 141*b* form a composite top wall 135*b*/137*b*/139*b*/141*b*.

A fifth end closure flap 135*a* is hinged by fold line 147*a* to the first end panel 115. A sixth end closure flap 137*a* is hinged by fold line 149*a* to the first side panel 117. A seventh end closure flap 139*a* is hinged by fold line 151*a* to second end panel 119. An eighth end closure flap 141*a* is hinged by fold line 153*a* to the second side panel 121. Each of the fifth, sixth, seventh, and eighth end closure flaps 135*a*, 137*a*, 139*a*, 141*a* is not connected to a corner panel 145*b*, 143*a*, 145*a*, 143*b*. Together the fifth, sixth, seventh, and eighth end closure flaps 135*a*, 137*a*, 139*a*, 141*a* form a composite bottom wall 135*a*/137*a*/139*a*/141*a*.

To form a flat, collapsed, part-formed shipping carton 157, the blank 113 is folded such that securing panel 123*a* is affixed to first corner panel 145*b*. This may optionally be achieved by folding the blank 113 about fold line 125 to bring the first corner panel 145*b* into face contacting relationship with the second side panel 117, and then applying adhesive to either the first corner panel 145*b* and/or the securing panel 123*a* before folding the second side panel 121 and securing panel 123*a* about fold line 129 and into adhering contact with the first corner panel 145*b*.

The flat form, part-assembled blank 113 can then be opened out into an open ended tubular structure and the bottom wall formed by folding and affixing the fifth, sixth, seventh, and eighth end closure flaps 135*a*, 137*a*, 139*a*, 141*a*. The open topped structure can then be top-loaded with at least one secondary packaging container 95. Optionally four secondary packaging containers 95 can be loaded into the tertiary shipping carton 157 (shown in FIG. 11). The four corner panels 14*a*, 14*b*, 16*a*, 16*b* of the four secondary packaging containers 95 are sized, configured and arranged to fit internally of and fit snugly against a corresponding one of the four corner structures 143*a*, 143*b*, 145*a*, 145*b* of the tertiary shipping carton 157. Once loaded, the tertiary shipping carton 157 can be closed by folding and affixing the first, second, third and fourth end closure flaps 135*b*, 137*b*, 139*b*, 141*b* thereby forming a composite top wall. Multiple tertiary shipping cartons 157 can be stacked one on top of the next due to the robust and strong structure. The stacking strength of the tertiary shipping carton 157 may be enhanced by the provision of the four corner structures 145*b*, 143*a*, 143*b*, 145*a*.

It can be appreciated that various changes may be made within the scope of the present invention, for example, the size and shape of the panels and apertures may be adjusted to accommodate articles of differing size or shape.

It will be recognized that as used herein, directional references such as "top", "bottom", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. A fold line is typically a scored line, an embossed line, or a debossed line. Any reference to hinged connection or fold line should not be construed as necessarily referring to a single fold line only; indeed it is envisaged that hinged connection can be formed from any one or more of the following, a short slit, a frangible line or a fold line without departing from the scope of the invention.

As used herein, the term "severance line" refers to all manner of lines that facilitate separating portions of the substrate from one another or that indicate optimal separation locations. Severance lines may be frangible or otherwise weakened lines, tear lines, cut lines, or slits.

It should be understood that hinged connection, severance lines and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The invention claimed is:

1. A package system comprising:

at least one secondary packaging container holding at least one primary container; and a tertiary packaging carton holding the at least one secondary packaging container, the at least one secondary packaging container comprising:

a base wall;

opposed first and second side walls;

opposed first and second end walls; and at least one corner structure disposed between an edge of the first side wall and an edge of the first end wall, the tertiary packaging carton comprising:

a base wall, wherein the base wall is formed by one or more panels as the tertiary packaging carton bottom;

opposed first and second side walls;

opposed first and second end walls;

a top closure; and at least one corner structure disposed between an edge of the first side wall and an edge of the first end wall, wherein, the at least one corner structure of the secondary packaging container is sized, configured, and arranged to fit internally of and adjacent to a corresponding one of the at least one corner structures of the tertiary packaging carton in a complementary, nested manner such that the secondary packaging container fits snugly within the tertiary packaging carton.

2. A package system according to claim 1 wherein the at least one corner structure of the at least one secondary packaging container comprises a first corner structure having a first corner panel disposed between the first side wall and the first end wall.

3. A package system according to claim 2 wherein the first corner panel is hinged to both the first side wall and the first end wall and sized to provide an acutely angled first corner structure.

4. A package system according to claim 2 wherein the at least one corner structure of the at least one secondary packaging container further comprises: a second corner structure having a second corner panel disposed between the first side wall and the second end wall, which second corner panel is hinged to both the first side wall and the second end wall; and a third corner structure having a third corner panel disposed between the second side wall and the second end wall, which third corner panel is hinged to both the second side wall and the second end wall.

5. A package system according to claim 4 wherein the secondary packaging container comprises a first securing panel, and wherein the at least one corner structure of the at least one secondary packaging container further comprises: a fourth corner structure having a fourth corner panel disposed between the second side wall and the first securing panel, which fourth corner panel is hinged to both the second side wall and the first securing panel.

6. A package system according to claim 1, wherein the package system comprises four secondary packaging containers, wherein the at least one corner structure of the tertiary packaging carton comprises four corner structures and wherein each corner structure of the tertiary packaging carton fits adjacent to a similarly formed and shaped corner structure of one of the four secondary packaging containers.

7. A package system according to claim 1, wherein the tertiary packaging carton is end loaded or top-loaded, and wherein the tertiary packaging container is a fully enclosed container and is a stackable container.

8. A package system according to claim 1 wherein the at least one corner structure of the tertiary packaging carton comprises a first corner panel disposed between the first side wall and first end wall.

9. A package system according to claim 1, wherein the continuously formed outer surface of each of the opposed first and second end walls of the at least one secondary packaging container extends from one side edge to an opposite side edge thereof.

10. A package system according to claim 1, wherein the secondary packaging container is of the basket carrier style having an open-topped structure, and comprises a medial handle structure connected to the first and second end walls and disposed between the first and second side walls.

11. A package system according to claim 1, wherein the base wall of the tertiary packaging carton is formed by one or more panels that are non-interlocking.

12. A set of blanks, the set of blanks comprising:

a blank for forming a secondary packaging container configured to hold a plurality of primary containers, and a blank for forming a tertiary packaging container configured to hold at least one secondary packaging container, the blank for forming the secondary packaging container comprising:

a base panel;

opposed first and second side panels;

opposed first and second end panels for forming opposed first and second end wads that each comprise a continuously formed outer surface viewed from outside each of the first and second end walls; and a corner structure disposed between the first side panel and the first end panel, such that the first side panel and the first end panel are spaced apart by the corner structure; and the blank for forming the tertiary packaging container comprising:

a base panel for forming a bottom wall as the tertiary packaging container bottom;

opposed first and second side panels;

opposed first and second end panels;

a top closure structure; and a corner structure disposed between the first ide panel and the first end panel, wherein the corner structure of the secondary packaging container as formed is sized, configured, and arranged to fit internally of and adjacent to the corner structure of the tertiary packaging container in a complementary, nested manner such that the secondary packaging container fits snugly within the tertiary packaging carton as formed.

13. A set of blanks according to claim 12, wherein the continuously formed outer surface of each of the opposed first and second end walls of the at least one secondary packaging container extends from one side edge to an opposite side edge thereof.

14. A set of blanks according to claim 12, wherein the secondary packaging container is of the basket carrier style having an open-topped structure, and the blank for forming the secondary packaging container comprises a medial handle structure connected to the first and second end panels and disposed between the first and second side panels in the secondary packaging container as formed.

15. A set of blanks according to claim 12, wherein the at least one corner structure of the blank for forming the secondary packaging container comprises a first corner structure having a first corner panel disposed between the first side wall and the first end wall.

16. A set of blanks according to claim 15, wherein the at least one corner structure of the blank for forming the secondary packaging container further comprises: a second corner structure having a second corner panel disposed between the first side panel and the second end panel, which second corner panel is hinged to both the first side panel and the second end panel; and a third corner structure having a third corner panel disposed between the second side panel and the second end panel, which third corner panel is hinged to both the second side panel and the second end panel.

17. A set of blanks according to claim 12, wherein the at least one corner structure of the blank for forming the tertiary packaging carton comprises a first corner panel disposed between the first side panel and the first end panel.

18. A set of blanks according to claim 17, wherein the at least one corner structure of the blank for forming the tertiary packaging carton further comprises: a second corner structure having a second corner panel disposed between the first side panel and the second end panel, which second corner panel is hinged to both the first side panel and the second end panel; and a third corner structure having a third corner panel disposed between the second side panel and the second end panel, which third corner panel is hinged to both the second side panel and the second end panel.

* * * * *